US009181668B1

(12) United States Patent
Hill

(10) Patent No.: US 9,181,668 B1
(45) Date of Patent: Nov. 10, 2015

(54) SHORELINE EROSION CONTROL ARRANGEMENT AND METHOD

(71) Applicant: Jordan S. Hill, Boynton Beach, FL (US)

(72) Inventor: Jordan S. Hill, Boynton Beach, FL (US)

( * ) Notice: Subject to any disclaimer, the term of this patent is extended or adjusted under 35 U.S.C. 154(b) by 0 days.

(21) Appl. No.: 14/206,943

(22) Filed: Mar. 12, 2014

Related U.S. Application Data

(62) Division of application No. 13/477,361, filed on May 22, 2012, now abandoned.

(51) Int. Cl.
*E02B 3/12* (2006.01)

(52) U.S. Cl.
CPC ..... *E02B 3/122* (2013.01)

(58) Field of Classification Search
CPC ..... E02B 3/12
USPC ..... 405/16, 284, 302.6
See application file for complete search history.

(56) References Cited

U.S. PATENT DOCUMENTS 3,315,408 A * 4/1967 Fisher ..... A01G 13/0268 405/16
5,338,131 A * 8/1994 Bestmann ..... E02B 3/125 405/15
5,425,597 A * 6/1995 Bestmann ..... E02B 3/125 405/16
5,658,096 A * 8/1997 Von Kanel ..... E02D 29/0241 405/16
6,368,017 B2 * 4/2002 Black ..... E03F 1/002 210/170.03
6,659,686 B2 * 12/2003 Veazey ..... A01K 61/005 14/28
6,893,193 B2 * 5/2005 Santha ..... E02B 3/12 405/15
2011/0110728 A1 * 5/2011 Kim ..... E02D 29/0225 405/284

* cited by examiner

*Primary Examiner* — Thomas B Will
*Assistant Examiner* — Katherine Chu
(74) *Attorney, Agent, or Firm* — Glenn E. Gold; Gold & Rizvi, P.A.

(57) ABSTRACT

A method for protecting and/or repairing a shoreline incorporates a liner material laid upon and following a contour of a scoured shoreline, a plurality of filled bags placed upon the liner material in a linear arrangement at or below an extreme low water shoreline and a volume of rock fill placed upon the liner material between a shore wall and the linear arrangement of the filled bags. An upper surface of the rock fill is preferably arranged forming a grading sloping downward from the shore toward the filled bags. A liner return segment is arranged covering the rock fill and secured to the shore. Vegetation is disposed upon and covering an exposed portion of the liner material to complete the restoration construction. The liner material can be a geotextile filter fabric paper. The filled bags can be concrete bags. The rock fill can include an aggregate of fifty-seven rock.

20 Claims, 8 Drawing Sheets

SHORELINE EROSION CONTROL ARRANGEMENT AND METHOD

FIELD OF THE INVENTION

The present disclosure generally relates to a method for restoring and subsequently protecting a shoreline.

BACKGROUND OF THE INVENTION

Shoreline along coastal regions or surrounding lakes and other bodies of water erode over time. The erosion reshapes the bank around the body of water. The changes in the bank can have an adverse affect on the landscape, adjacent structures, and the like. For the purpose of this disclosure, the term "shoreline" is intended to encompass the boundary line between of any body of water and land.

Shoreline erosion may due to one or more of a variety of factors including, for example, water motion, wave action, irrigation of landscaping, rainfall runoff, settling, gravity, loss of vegetation, earthquakes, loosening of ground structure caused by burrowing and other motion of animals, fish, wildlife, and the like.

Motion of the water can also be caused by any of a number of conditions including, for example, wind across a fetch, tidal flows, man-driven flow (such as drainage pumping), action of animals, motion of boats, water flow, drainage structures, pool drainage, irrigation runoff, rainfall collection, and the like.

Settling occurs as fine sediment filling in areas between larger constituents, such as rocks, is drawn away from a shoreline, bank, and/or coastline. The removal of the sediment reduces support and stability of the larger constituents. The less stable larger constituents are then subjected to effects of gravity, causing them to move downward towards a basin of the body of water.

Vegetation can spreads roots throughout the upper portion of a shoreline, bank, and/or coastline regions. The roots tend to collect and retain sediment. The less plants growing in the soil, the more likely that erosion will occur. If the vegetation is removed or dies off, the effect of the beneficial effects of roots in reducing erosion is diminished. Vegetation can be impacted by changes in the shoreline. As the water rises, the water can kill the vegetation. The loss of vegetation reduces the support of the shoreline composition (e.g., sediment, sand, rocks, shells, and dirt), causing degradation of the shoreline.

Any other introduction of movement to the coastal or shoreline area could further aid in erosion. Movement of animals, fish, and wildlife along the shoreline, earthquakes, wind, and the like can all contribute to the degradation of the shoreline.

Various methods are known for aiding in the restoration of degraded shoreline and minimizing/preventing subsequent erosion of shoreline regions along bodies of water. However, each of the known solutions has disadvantages, drawbacks and/or limitations.

A common method of restoration is simply re-grading and re-sodding along an eroded stretch of shoreline. This fails to provide a long-term, preventative solution to the erosion problem.

It is known to use certain structures such as sheet pilings and bulkheads along a shore to provide a vertical barrier between the shoreline region and the water. Sheet pilings are a retaining wall providing a barrier between the land and the body of water. The sheet pilings are commonly fabricated of reinforced concrete or steel sheets. These present an unnatural and, to some extent, an unsightly appearance that are often discouraged by water control districts.

An alternative to sheet pilings is referred to as a riprap, which comprises layers of filled bags creating a barrier between the shoreline area and the body of water. The bags are commonly arranged on an incline. Alternatively, the riprap can be fabricated of dispensed rubble, such as varying sized rocks. The riprap can be considered unsightly.

Another restoration method involves the deployment of gabions. Gabions are cages or baskets deployed to retain soil and stabilize the shoreline, with the goal of controlling the rate of erosion. The gabions are typically stacked in layers to form a wall or barrier in a similar manner as the filled bags creating the aforementioned riprap. The gabions can be considered unsightly. In order to deter corrosion of the artificial structure, gabions are commonly fabricated of stainless steel, which significantly raises the cost of the restoration process.

Another restoration method is the application of a covering material to the affected area, wherein the covering is intended to secure the underlying soil. This solution relies upon the longevity of the material, adequate cover, and remains void of deterring any underlying erosion.

Accordingly, there is a long felt and unmet need for a shoreline erosion restoration and prevention method that can be efficiently implemented to effectively restore an eroded shoreline and/or prevent future shoreline erosion, and which retains a shoreline region in a natural looking, aesthetically-pleasing along a body of water in a desirable arrangement over an extended period of time. The system would include features to protect the areas against erosion resulting from any number of common and normal occurrences, such as water flow, rainfall, storms, wind, animals, and the like.

SUMMARY OF THE INVENTION

For clarity, any reference herein to a "shore" or a "shoreline" is intended to encompass any boundary line along or between any body of water and land, which may include, for example, a shore, a lake bank and coastline. A shore is commonly understood to represent a portion of land located proximate an edge of a sea, a lake, a broad river, and the like; a lake bank is commonly understood to represent a portion of land located proximate an edge of a lake; and a coast is commonly understood to represent a portion of land located proximate a sea or ocean.

The present disclosure is generally directed towards a shoreline restoration and protection method utilizing an arrangement comprising:

a scoured shoreline including a substantially vertical transition between a foreshore and a shore and a generally horizontal excavated foreshore region;

a liner material fabricated of a flexible material covering the scoured shoreline along at least a portion of a shoreline provided along a body of water, the liner material comprising:

- a shore wall liner segment covering the substantially vertical transition,
- a foreshore liner segment covering the generally horizontal excavated foreshore region, and
- a return segment of liner material extending from the generally horizontal excavated foreshore region; and a volume of rock fill placed upon a section of the sheet of flexible material covering the excavated foreshore region; and a plurality of filled bags, the plurality of filled bags placed upon the section of the sheet of flexible material covering the excavated foreshore region in a linear arrangement at or below the along the extreme low water shoreline; and the liner return segment being wrapped about the linear arrangement of filled bags, covering the volume of rock fill, extending to a region of the shoreline at or above the vertical wall.

In an implementation, the rock fill may comprise so-called fifty-seven rock infill.

In another implementation, the liner material is geotextile filter fabric paper. The preferred weight of the geotextile filter fabric paper is 6 ounces.

In another implementation, the filled bags are concrete filled bags.

In another implementation, the shoreline protection arrangement further comprises vegetation disposed upon the liner covering an exposed portion of the liner material.

In another implementation, the vegetation is one of sod and grass.

In another implementation, the liner material is secured to the filled bags by a plurality of securing fasteners, such as pins, nails, stakes, and the like.

In another implementation, the liner material is pinned to the shore by a plurality of securing fasteners, such as pins, nails, stakes, and the like.

In another implementation, the scoured shoreline is a naturally formed scoured shoreline created by natural erosion along a shoreline.

In another implementation, the scoured shoreline is a man-made scoured shoreline created by an excavation process.

In another implementation, a temporary barrier is temporarily deployed proximate to a predetermined linear location receiving the plurality of filled bags.

In another implementation, the rock fill is arranged having an upper surface forming a grading extending downward from the shore to the plurality of filled bags.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
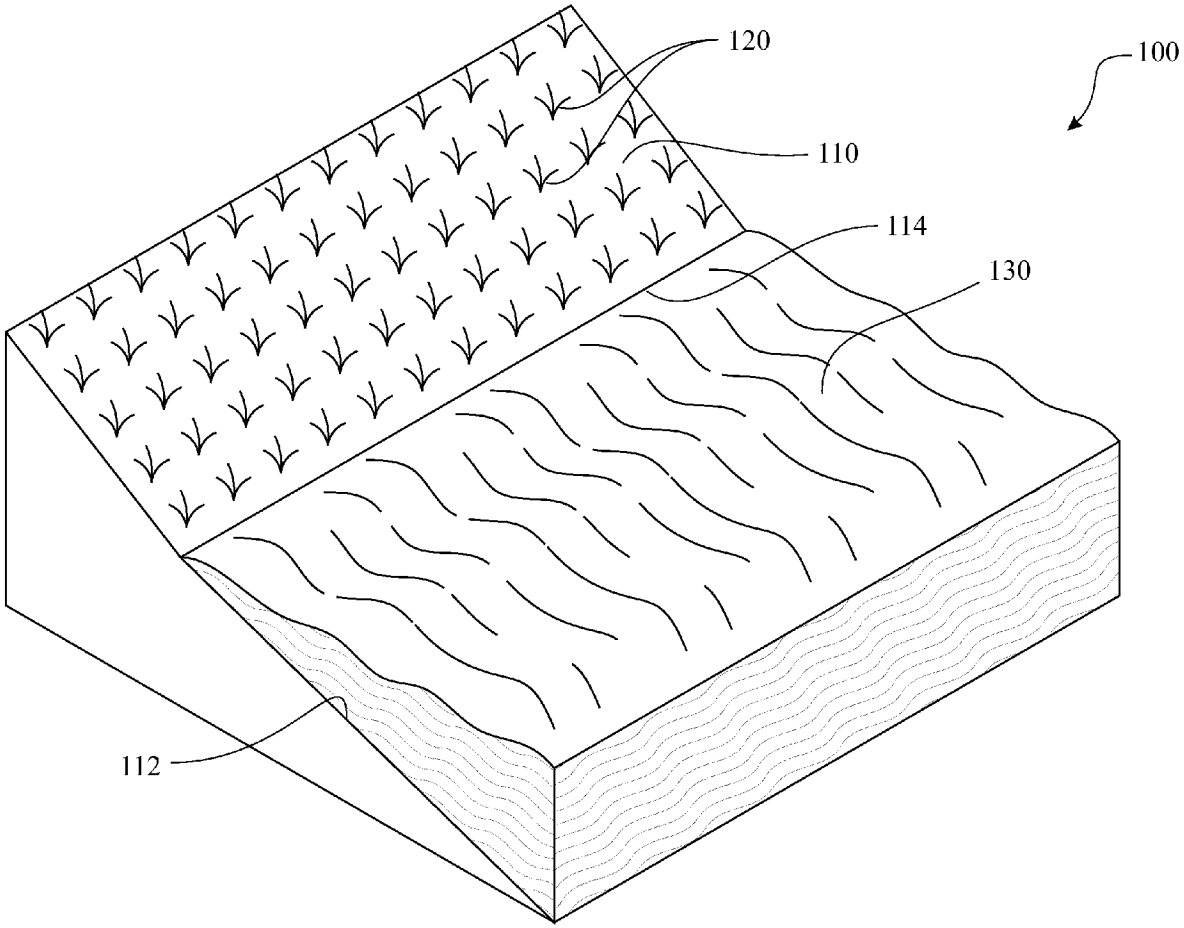
FIG. 1 presents an isometric view of an exemplary original shoreline configuration.
Figure 2:
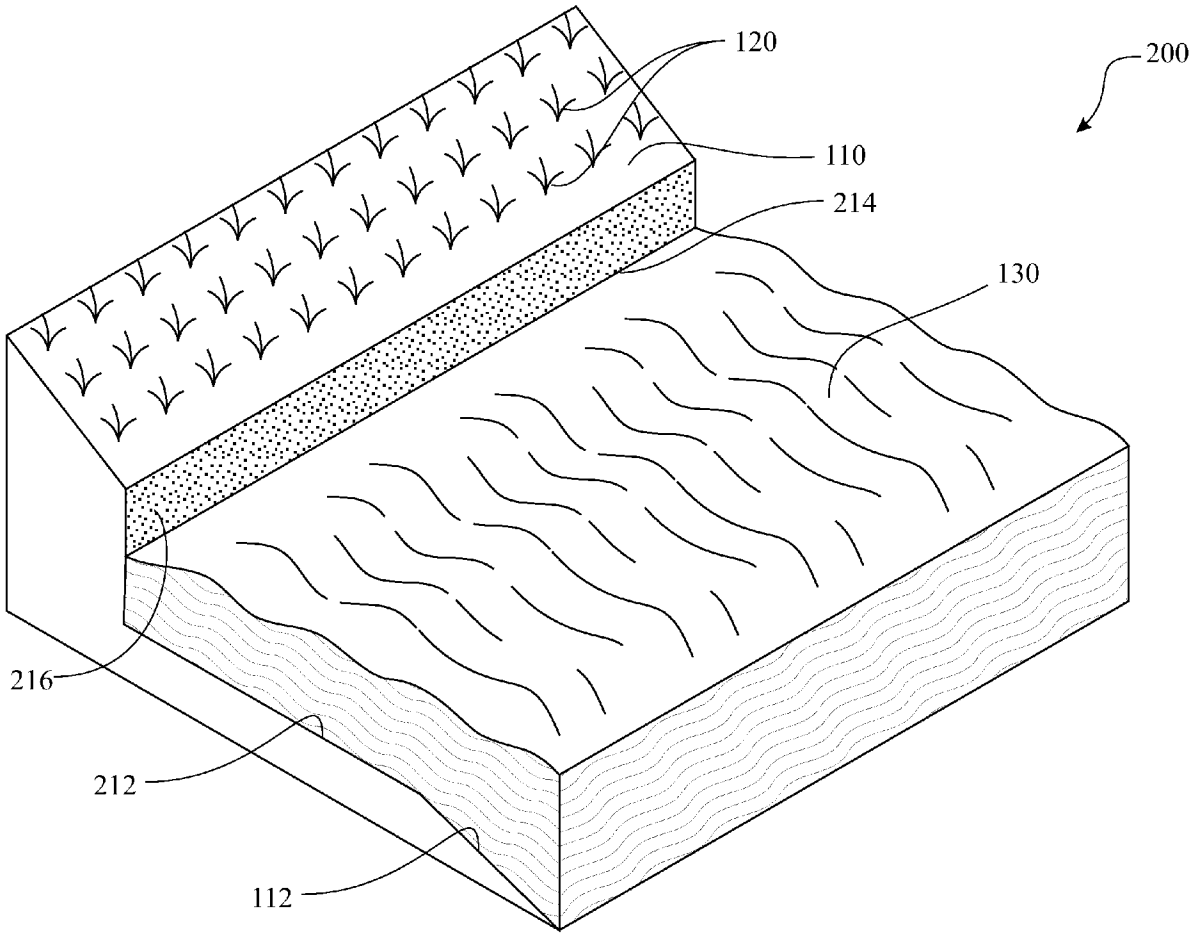
FIG. 2 presents an isometric view of an exemplary eroded shoreline configuration.

A shoreline is the fringe of land at the edge of a body of water, such as an ocean, sea, lake, pond, river, and the like, as detailed in the exemplary original shore configuration 100 illustrated in FIG. 1. Features of the original shore configuration 100 include a shoreline 114, which defines a boundary between a shore 110 and a body of water 130. The shore 110 is commonly covered with a vegetation growth covering 120. The vegetation growth covering 120 provides aesthetics to the shore 110 and aids in retaining the soil against erosion. A foreshore 112 extends from the shoreline 114 along a slope of the ground underneath the water 130. Erosion of the shore 110 can be caused by any of many factors, including motion of the adjacent water, wave action, storm events, wind, irrigation of landscaping, rainfall runoff, settling, gravity, loss of vegetation, earthquakes, being loosened by burrowing and other motion of animals, and the like. Natural erosion can remove a portion of the shore 110 and foreshore 112 to create an eroded shore configuration 200 as shown in the exemplary illustration presented in FIG. 2. The erosion process can remove soil from underneath the vegetation growth covering 120. The erosion creates an eroded foreshore 212 and a vertical drop off 216 between the shore 110 and the foreshore 112. The vertical drop off 216 could accelerate erosion, as forces from the water 130 directed against the vertical drop off 216 are less dissipated than when the water 130 washes against a slope the foreshore 112. The foreshore 112 dissipates the forces of the water 130, as the slope enables the water 130 to flow upwards allowing gravity and friction to reduce the forces applied by the motion of the water 130 as the water 130 flows upwards onto the foreshore 112. The eroded shore configuration 200 changes the location of the shoreline 114 from one that is along a sloping surface to a modified shoreline 214, which marries the water 130 against a substantially vertical wall that is formed by the vertical drop off 216. In contrast, forces applied by the motion of the water 130 against a generally vertical wall formed by the back of the vertical drop off 216 are subject to the entire impact of the wave.

Figure 3:
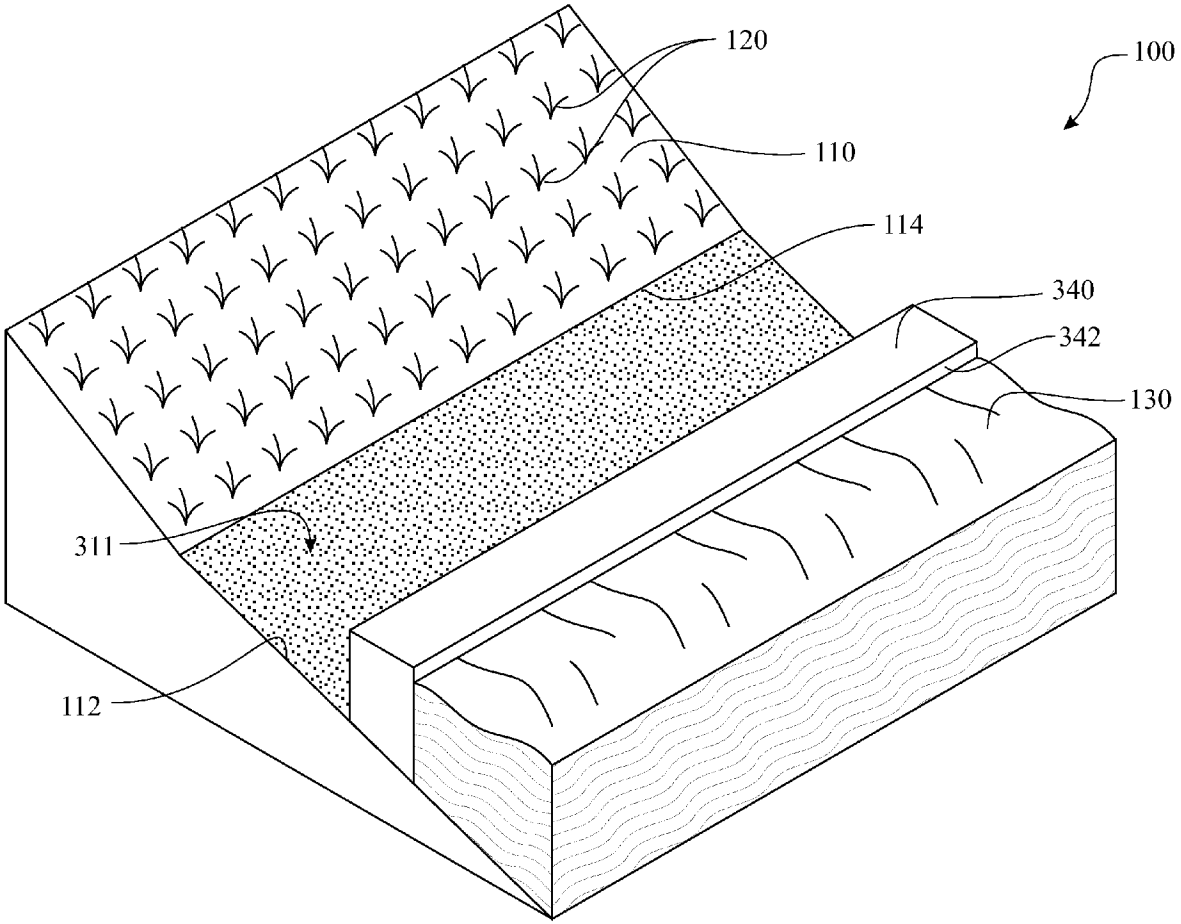
FIG. 3 presents an isometric view of an exemplary first stage for excavating a shoreline.
Figure 4:
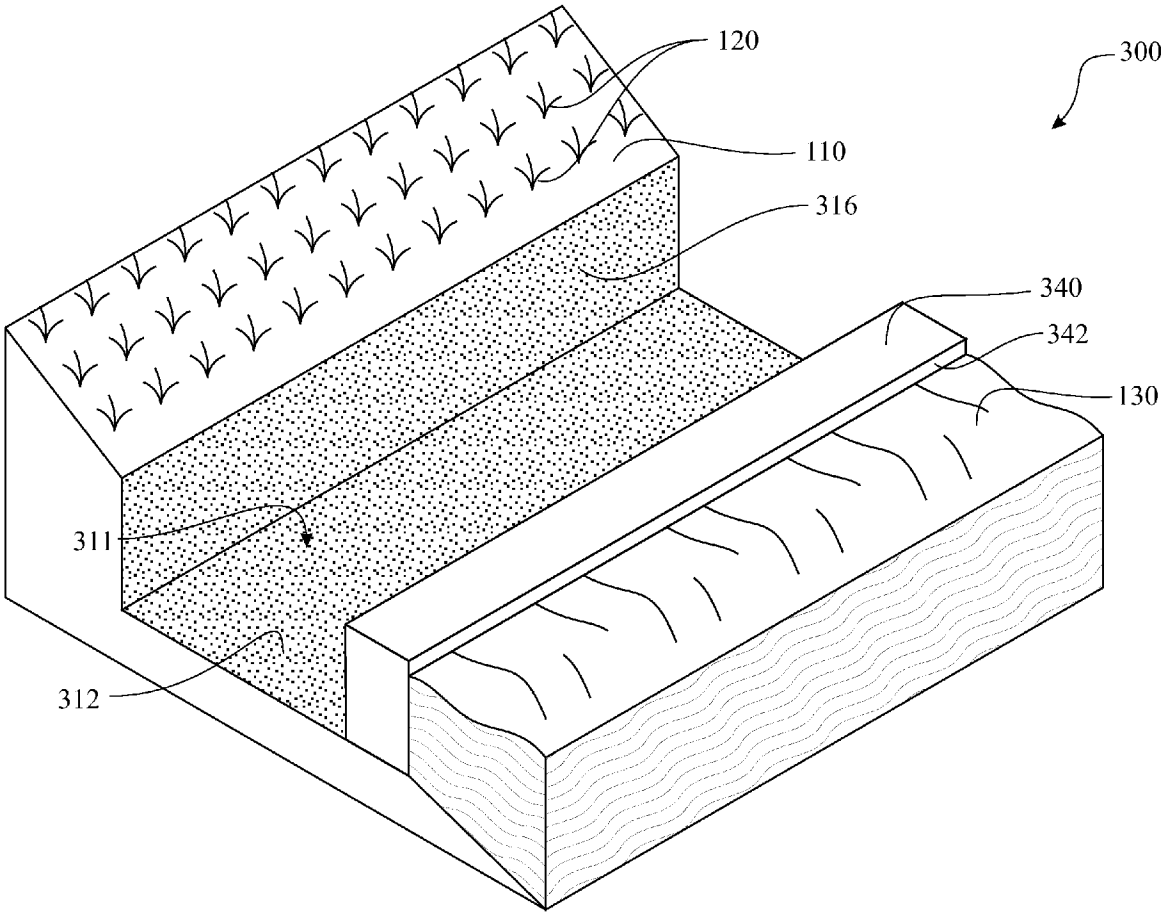
FIG. 4 presents an isometric view of the exemplary excavated shoreline configuration.

The present method provides a means for protecting, and if necessary, restoring the shore 110. The initial step of a process for constructing a shoreline restoration and protection system begins with a step of excavating a portion of the foreshore 112 (referred to as an excavated shore region 311)

to form an excavated shore configuration 300 comprising an excavated foreshore region 312 and an excavated rear slope or wall 316. In a scenario where the shoreline restoration and protection system initiates with an eroded shore configuration 200, the erosion process naturally forms the excavated foreshore region 312 and excavated rear slope or wall 316. An optional temporary barrier 340 can be temporarily deployed proximate to a predetermined linear location defining a lower edge of the shoreline restoration and protection system, as illustrated in FIGS. 3 and 4. The temporary barrier 340 provides a water barrier surface 342, which retains the water 130 from the area for excavation. The temporary barrier 340 can be any suitable temporary barrier known by those skilled in the art. The temporary barrier 340 would be deployed and a portion of the water 130 remaining between the temporary barrier 340 and the shore 110 is pumped to the opposite side of the temporary barrier 340. The volume of ground material calculated for excavation by engineering is removed using any equipment and respective processes known by those skilled in the art.

Figure 5:
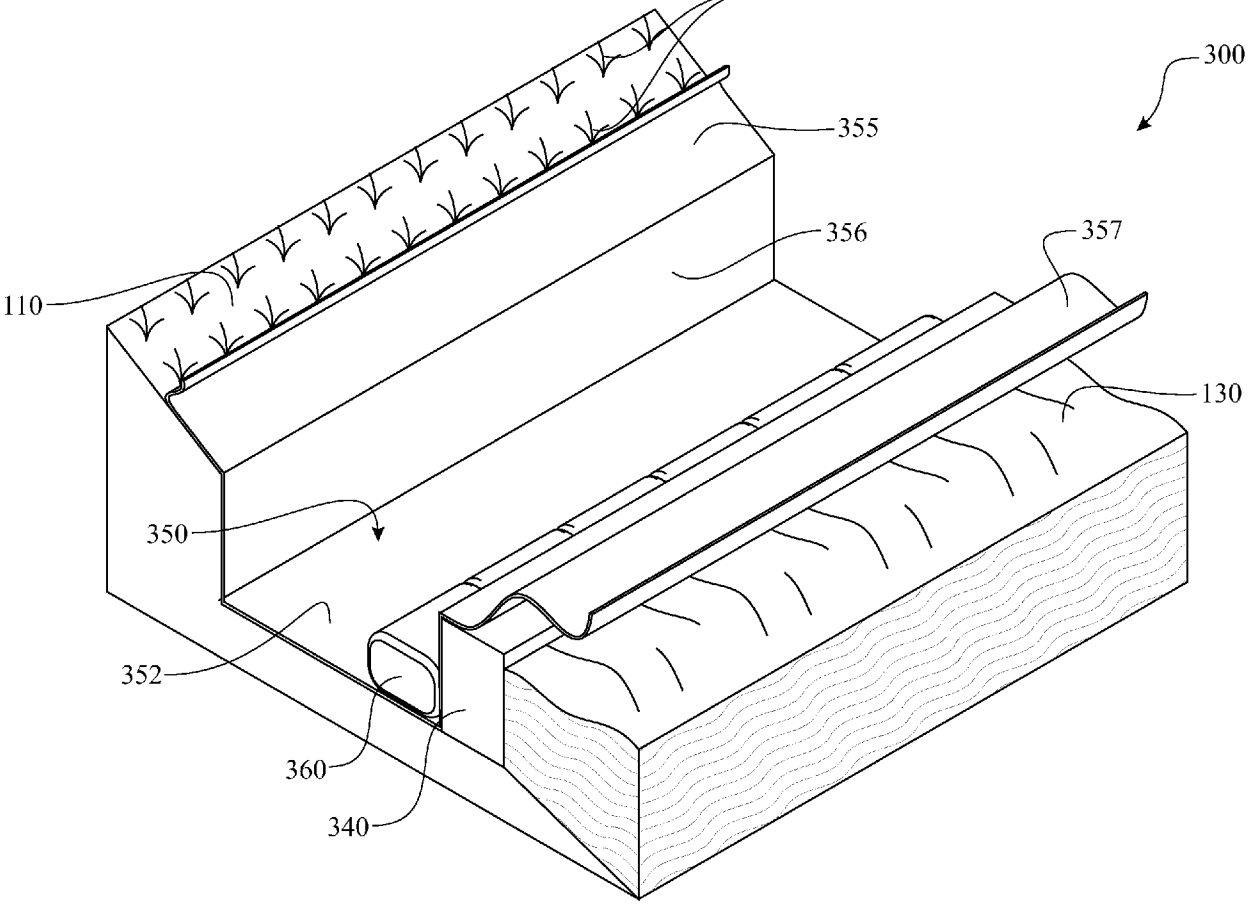
FIG. 5 presents an isometric view of exemplary initial construction step for forming a shoreline restoration and protection system.

A liner material 350 is laid out upon the region that is undergoing installation of the shoreline restoration and protection system, as illustrated in FIG. 5. The liner material 350 is preferably fabricated of a non-woven fabric, such as a fabric-like material made from long fibers, bonded together by chemical, mechanical, heat or solvent treatment. One example of a porous non-woven material would be 6 oz geotextile filter fabric paper. The liner material 350 can be described in a plurality of segments, which define each directional segment thereof. A liner material 350 initiates with a shoreline liner segment 355 deployed along the shore 110; and continuing with a rear wall liner segment 356 deployed along the excavated rear slope or wall 316 transitioning into a foreshore liner segment 352 deployed upon the excavated foreshore region 312. A remaining section (referred to as a liner return segment 357) of the liner material 350 is gathered about the temporary barrier 340 (when deployed) or the predetermined linear location defining a lower edge of the shoreline restoration and protection system. The excavated foreshore region 312 and excavated rear slope or wall 316 can be formed by natural erosion, excavation, or both.

Figure 6:
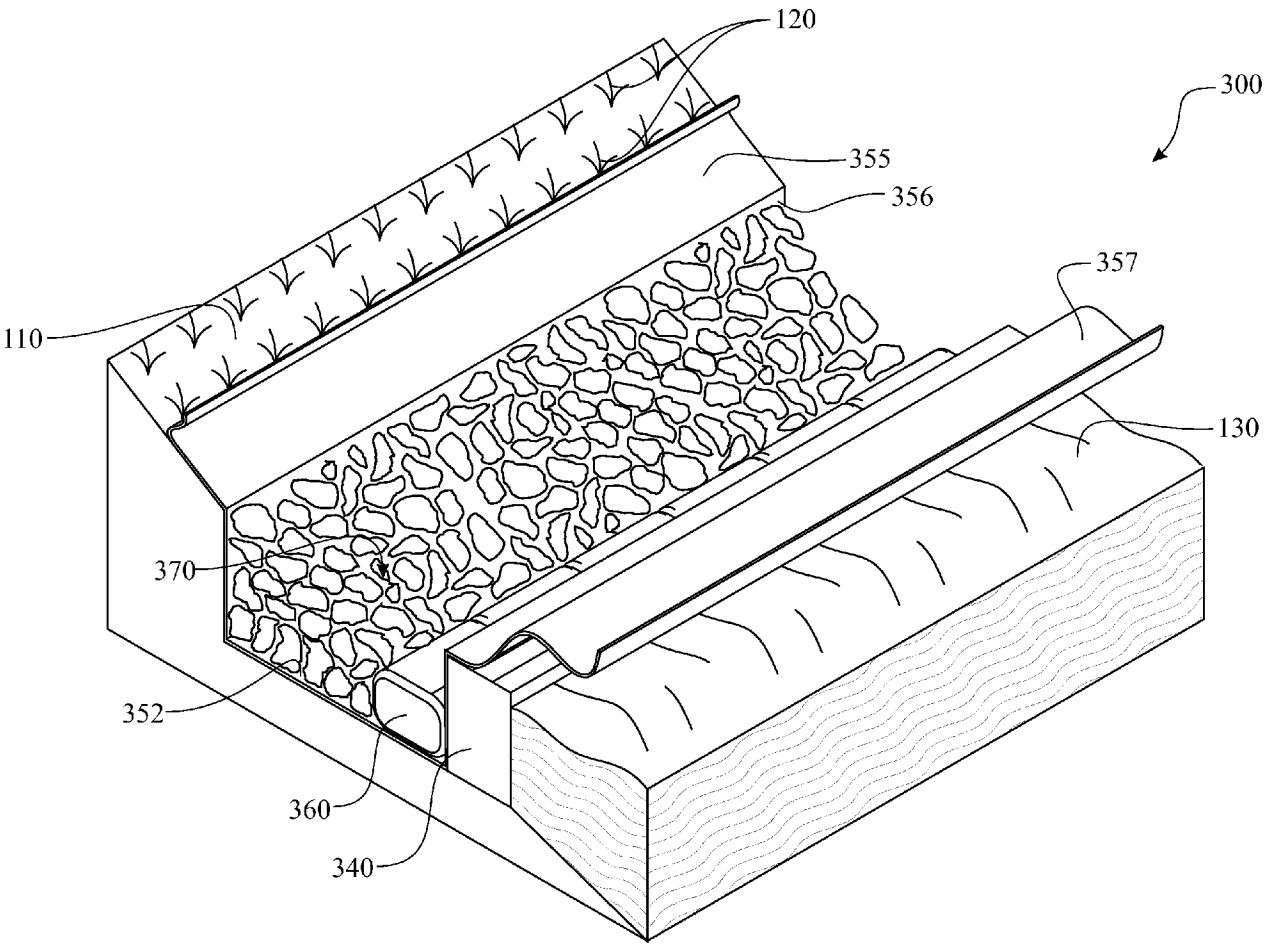
FIG. 6 presents an isometric view of exemplary second construction step for forming a shoreline restoration and protection system.
Figure 7:
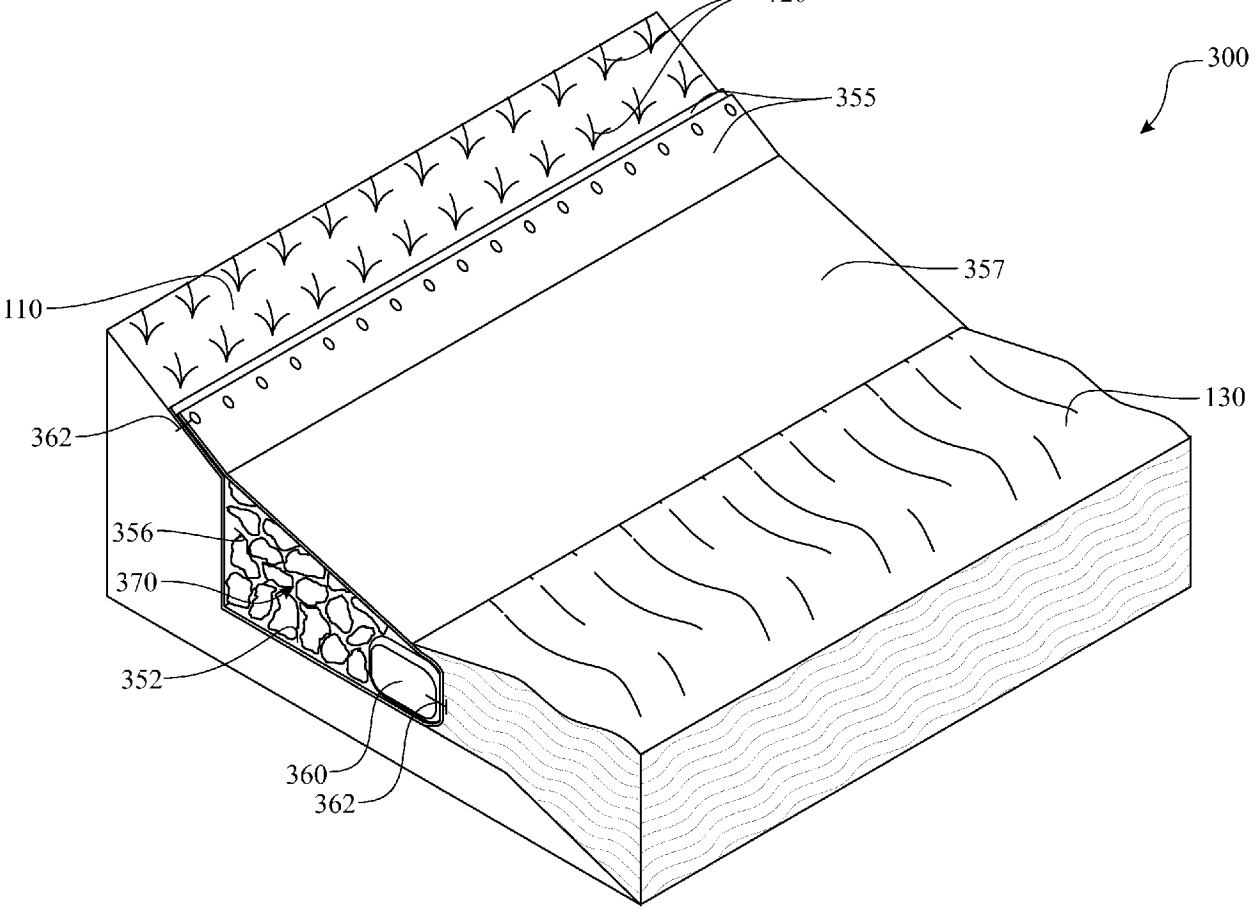
FIG. 7 presents an isometric view of exemplary third construction step for forming a shoreline restoration and protection system.
Figure 8:
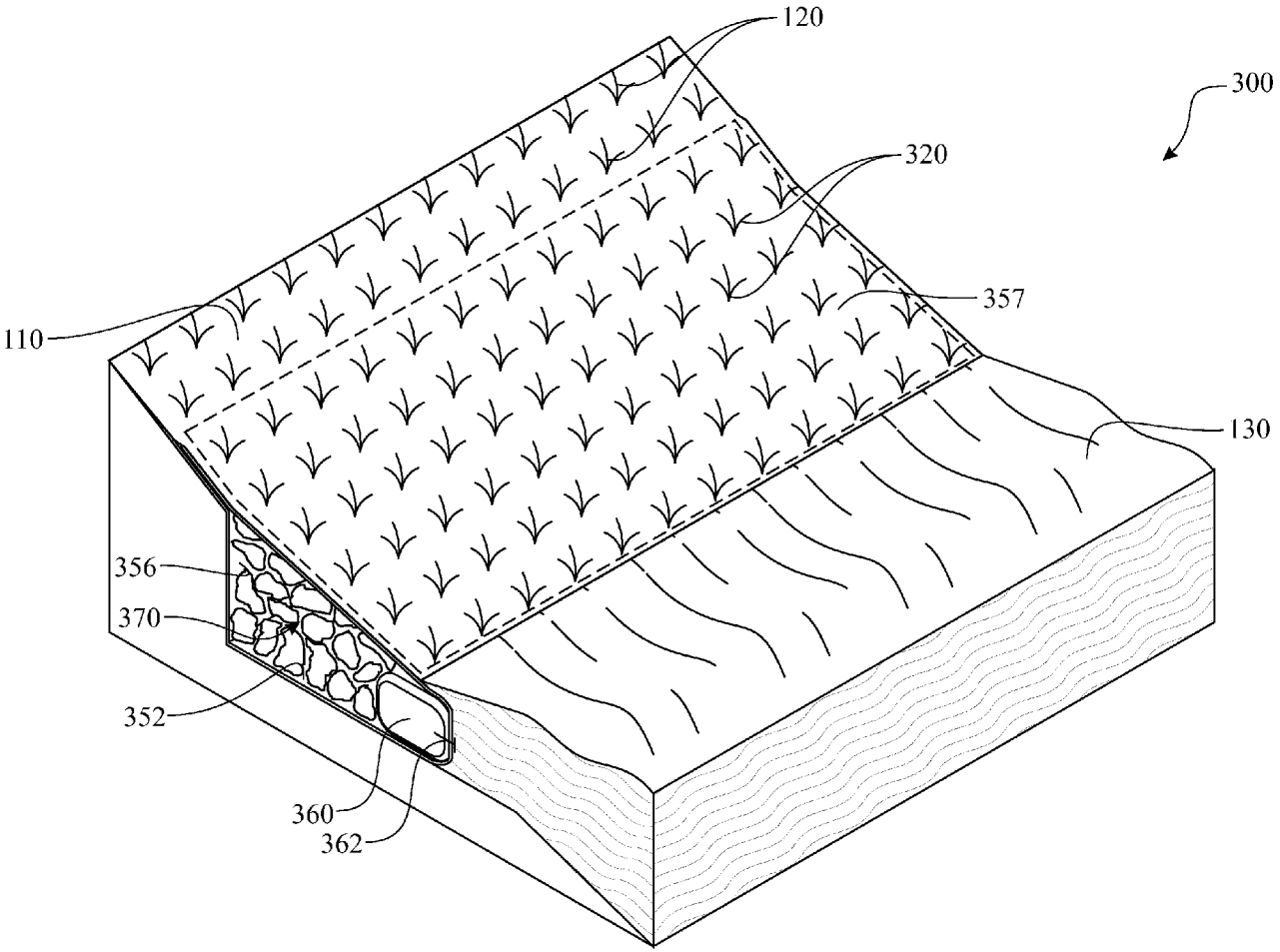
FIG. 8 presents an isometric view of exemplary final construction step for forming a shoreline restoration and protection system.

A plurality of filled bags 360 is placed upon the liner material 350 along the predetermined linear location defining a lower edge of the shoreline restoration and protection system. The filled bags 360 are preferably concrete bags. It is understood that the filled bags 360 can be any filled with any dense, stable material for retention of the liner material 350 in position, including rocks, gravel, soil, and the like. A volume of rock fill 370 is dispensed into the channel formed by rear wall liner segment 356, the foreshore liner segment 352, and the filled bags 360, as illustrated in FIG. 6. The rock fill 370 is preferably and aggregate referred to as fifty-seven rock. An upper surface of the rock fill 370 is preferably arranged forming a grading sloping downward from the shore 110 to the plurality of filled bags 360.

The liner return segment 357 is pulled towards the shore 110, covering the rock fill 370 and a portion of the shore 110. If placed, the optional temporary barrier 340 is removed, allowing the water 130 to return to the natural shoreline 114. The liner material 350 can be secured in position by inserting a plurality of securing fasteners 362 through the liner material 350 and into the filled bags 360 and/or the shore 110. The securing fasteners 362 can be any securing device, including pins, nails, stakes, and the like Restoration vegetation 320 is placed upon the liner return segment 357 covering an exposed portion of the liner material 350. The restoration vegetation 320 can be disbursed partially or completely over the exposed portion of the liner material 350. A partial disbursement would anticipate growth of the restoration vegetation 320 to eventually cover the entire exposed portion of the liner material 350. The restoration vegetation 320 can be any vegetative growth, including grass, sod, flowers, bushes, and the like.

The shoreline restoration and protection system combines the liner material 350, the filled bags 360, the rock fill 370 and the restoration vegetation 320 which interact with one another as a unitary solution to the erosion problem. The liner material 350 provides several functions, including stabilization of the excavated foreshore region 312 and excavated rear slope or wall 316, as well as containment of the rock fill 370. The restoration vegetation 320 provides an aesthetic aspect to the shoreline restoration and protection system.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A method for modifying a shoreline from an original configuration to a reconstructed configuration, the original configuration being at least partially eroded and defined by a downwardly-sloping exposed shore region having an exposed shore region surface gradient and terminating at a naturally-eroded vertical drop off region having an exposed face, the method comprising the steps of:

separating the naturally-eroded drop off region from a non-eroded downwardly-sloped original foreshore region having an original foreshore region surface gradient, by an excavated foreshore region, the excavated foreshore region contiguous with the original foreshore region;

disposing a contiguous layer of a liner material over at least a partial surface area of said exposed shore region, over at least a partial surface area of said vertical drop off region, over at least a partial surface area of said excavated foreshore region, and over at least a partial surface area of said original foreshore region, the portion of the liner material over at least a partial surface area of said original foreshore region defining a liner return portion;

disposing a plurality of material-filled bags atop an area of said liner material covering said excavated foreshore region adjacent said original foreshore region, thereby forming a channel volume generally defined by said exposed face of said vertical drop off region, said material filled bags and an area of said excavated foreshore region not covered by said material-filled bags;

disposing a volume of rock fill into said channel volume such that an upper area of said rock fill defines a rock fill upper area gradient that approximates said exposed shore region surface gradient;

pulling said liner return portion back over said material-filled bags toward said exposed shore region such that said liner return portion covers said material-filled bags, said volume of rock fill and at least a portion of said exposed shore region;

securing said liner return portion to said exposed shore region; and disposing restoration vegetation upon an upper surface of said liner return portion.

2. A method for modifying a shoreline from an original configuration to a reconstructed configuration as recited in claim 1, wherein a body of water covers both the original and excavated foreshore regions, and butts up against the exposed face of the vertical drop off region, the method further comprising the steps of:

prior to the step of disposing a contiguous layer of a liner material, deploying a temporary barrier proximate to a boundary region where said excavated foreshore region transitions into said original foreshore region, such that said temporary barrier effectively isolates said excavated foreshore region from subsequent encroachment of water from said body of water into said excavated foreshore region; and prior to the step of securing said liner return portion to said exposed shore region, removing said temporary barrier;

wherein, the step of disposing a contiguous layer of a liner material further comprises disposing said layer over at least a partial surface area of said exposed shore region, over at least a partial surface area of said vertical drop off region, over at least a partial surface area of said excavated foreshore region, and over at least a partial surface area of said deployed temporary barrier, the portion of liner material over said deployed temporary barrier defining a liner return portion; and wherein, the step of disposing a plurality of material-filled bags further comprises disposing said material-filled bags atop an area of said liner material covering said excavated foreshore region adjacent said temporary barrier, thereby forming a channel volume generally defined by said exposed face of said vertical drop off region, said material-filled bags and an area of said excavated foreshore region not covered by said material-filled bags.

3. A method for constructing a shoreline restoration and protection system, comprising the steps of:

excavating a portion of an eroded foreshore between a shore and an non-eroded foreshore, forming an excavated rearwardly-sloping wall adjacent the shore and an excavated foreshore;

placing a contiguous length of liner material including a shore liner portion over a portion of the shore, a rear wall liner portion over the excavated rearwardly-sloping wall, a foreshore liner portion over the excavated foreshore, and a liner return portion over and gathered about a predetermined linear location defining a lower edge of the shoreline restoration and protection system;

placing a plurality of material filled bags upon a portion of the liner material along the predetermined linear location;

dispensing a volume of rock fill into a channel formed by the rear wall liner portion, the foreshore liner portion, and the material filled bags, an upper surface of the rock fill forming a grading sloping downward in a direction from the shore toward the material filled bags;

pulling the liner return portion towards the shore, thereby covering the rock fill and a portion of the shore;

securing the liner return portion in position; and placing restoration vegetation upon the liner return portion, covering an exposed portion of the liner material.

4. A method for constructing a shoreline restoration and protection system as recited in claim 3, wherein the liner return portion is secured in position by inserting a plurality of securing fasteners through the liner material and into the shore.

5. A method for constructing a shoreline restoration and protection system as recited in claim 4, wherein the liner return portion is additionally secured in position by inserting a plurality of securing fasteners through the liner material and into the material filled bags.

6. A method for constructing a shoreline restoration and protection system as recited in claim 3, wherein the liner material is fabricated of a woven fabric.

7. A method for constructing a shoreline restoration and protection system as recited in claim 6, wherein the woven fabric is constructed from a plurality of long lengths of fiber, the fibers bonded together by at least one of a chemical, mechanical, heat and solvent treatment.

8. A method for constructing a shoreline restoration and protection system as recited in claim 7, wherein the woven fabric further comprises a geotextile filter fabric paper.

9. A method for constructing a shoreline restoration and protection system as recited in claim 8, wherein the geotextile filter fabric paper further comprises 8-ounce geotextile filter fabric paper.

10. A method for constructing a shoreline restoration and protection system as recited in claim 3, wherein the material-filled bags further comprises bags filled with a material having adequate density and stability for retaining the liner material in a desired fixed position.

11. A method for constructing a shoreline restoration and protection system as recited in claim 10, wherein the dense, stable material is chosen from the group consisting of rocks, gravel and soil.

12. A method for constructing a shoreline restoration and protection system as recited in claim 10, wherein the material-filled bags further comprises concrete-filled bags.

13. A method for constructing a shoreline restoration and protection system as recited in claim 3, wherein the rock fill further comprises at least one of fifty-seven rock and crushed concrete aggregate.

14. A method for constructing a shoreline restoration and protection system as recited in claim 3, wherein the restoration vegetation is disbursed to completely cover the exposed portion of the liner material.

15. A method for constructing a shoreline restoration and protection system as recited in claim 3, wherein the restoration vegetation is disbursed to partially cover the exposed portion of the liner material.

16. A method for constructing a shoreline restoration and protection system as recited in claim 3, wherein the restoration vegetation is chosen to include at least on of grass, sod, flowers and bushes.

17. A method for constructing a shoreline restoration and protection system, comprising the steps of:

excavating a portion of an eroded foreshore between a shore and an non-eroded foreshore, forming an excavated rearwardly-sloping wall adjacent the shore and an excavated foreshore;

deploying a temporary barrier proximate to a predetermined linear location, which defines a lower edge of the shoreline restoration and protection system;

disposing a contiguous length of a liner material, the length including a shore liner portion disposed over a portion of the shore, a rear wall liner portion disposed over the excavated rearwardly-sloping wall, a foreshore liner portion disposed over the excavated foreshore, and a liner return portion disposed over and gathered about the previously deployed temporary barrier;

placing a plurality of material-filled bags upon a portion of the length of liner material positioned along the predetermined linear location;

dispensing a volume of rock fill into a channel defined by the rear wall liner portion, the foreshore liner portion and the material filled bags, an upper surface of the rock fill forming a grading sloping downward in a direction from the shore toward the material-filled bags;

pulling the liner return portion in a direction toward the shore to adequately cover the rock fill and at least a portion of the shore;

securing the liner return portion in a desired position; and disposing restoration vegetation upon the liner return portion, thereby covering a previously-exposed portion of the liner material.

18. A method for constructing a shoreline restoration and protection system as recited in claim 17, wherein the temporary barrier includes a water barrier surface for substantially preventing the undesired introduction of water into said liner-covered excavated region.

19. A method for constructing a shoreline restoration and protection system as recited in claim 17, further comprising, prior to the step of disposing a contiguous length of liner material, the step of:

removing any undesirable volume of water located between the shore and the temporary barrier.

20. A method for constructing a shoreline restoration and protection system as recited in claim 17, further comprising, prior to the step of securing the liner return portion, the step of removing the temporary barrier.

* * * * *